United States Patent [19]

Ritchart

[11] 4,429,705

[45] Feb. 7, 1984

[54] MANUALLY ACTUATED FUEL VALVE CONTROL

[75] Inventor: Stuart T. Ritchart, Burnsville, Minn.

[73] Assignee: Honeywell Inc., Minneapolis, Minn.

[21] Appl. No.: 346,334

[22] Filed: Feb. 5, 1982

[51] Int. Cl.[3] ..... F23D 5/16

[52] U.S. Cl. ..... 137/65; 60/432; 318/467; 361/194

[58] Field of Search ..... 417/26, 38, 44; 60/432; 137/65; 200/1 B; 318/467; 361/194, 189; 251/25

[56] References Cited

U.S. PATENT DOCUMENTS

| | | | |
|---|---|---|---|
| 677,891 | 7/1901 | Carichoff | 318/467 |
| 1,790,009 | 1/1931 | Karnath . | |
| 2,022,035 | 11/1935 | Grob . | |
| 2,388,369 | 11/1945 | Shendrick . | |
| 2,469,609 | 5/1949 | Ray . | |
| 2,735,445 | 2/1956 | Ray et al. . | |
| 2,849,670 | 8/1958 | McIntosh et al. . | |
| 2,875,773 | 3/1959 | Matthews . | |
| 2,890,016 | 6/1959 | Hajny . | |
| 3,219,779 | 11/1965 | Ziegler | 318/467 |
| 3,954,383 | 5/1976 | Bryant . | |
| 4,054,155 | 10/1977 | Hill | 60/432 |
| 4,090,532 | 5/1978 | Story, Jr. . | |
| 4,098,284 | 7/1978 | Yamada . | |
| 4,156,432 | 5/1979 | Helwig, Jr. . | |
| 4,262,687 | 4/1981 | Kobayashi . | |
| 4,263,928 | 4/1981 | Kobayashi et al. . | |
| 4,358,646 | 11/1982 | Martinez | 200/1 B |

*Primary Examiner*—Martin P. Schwadron
*Assistant Examiner*—Stephen M. Hepperle
*Attorney, Agent, or Firm*—Alfred N. Feldman

[57] ABSTRACT

A hydraulic actuator and valve are used for the control of fuel to a burner. The actuator is energized to open the valve through a manual start switch and a manual reset switch to prevent the manual start switch from being held in either accidentally or intentionally to overcome a safety monitoring control, such as a flame safeguard programmer.

9 Claims, 3 Drawing Figures

MANUALLY ACTUATED FUEL VALVE CONTROL

BACKGROUND OF THE INVENTION

Many fuel burner systems, particularly large industrial process types of burners, are manually started and are then monitored by a flame detector and a safety system. Typically these systems are controlled by a unit referred to as a flame safeguard programmer, and once a manual start of the system has been accomplished, the flame safeguard programmer takes over monitoring and safe shutdown of the fuel valve in the event of a loss of flame, or the need to shut down the burner.

The large industrial type burners typically are manually started by the depression of a momentary start switch, and they further include a valve which must be manually operated and latched electromagnetically into an open position. This type of valve is commonly referred to as a "free" handle type of valve and is a very expensive type of unit. Also, it is not uncommon to find installed "free" handled valves blocked open when the holding solenoid fails. This is done by removing the side cover of the mechanism and placing a matchbook, block of wood, etc. in front of the solenoid, thereby entirely defeating the safety aspect of the valve.

DESCRIPTION OF THE INVENTION

The present invention is directed to a valve control system that allows for manual opening of a fuel valve from a push button, but provides a means for ensuring that the valve cannot be blocked open by continuously pushing the manual start switch.

The present system utilizes a hydraulic actuator that contains a pump, and a bypass or dump valve. The pump acts on a hydraulic fluid that in turn operates on a bellows or piston to move an actuator member. The actuator member is connected to the stem of a valve to operate or open the valve. The closing of the fuel valve is accomplished by opening the dump valve (its deenergized position), and allowing the hydraulic fluid to be bypassed around the pump and return to a reservoir within the unit. A spring bias within the mechanism provides the return force of the actuator and thereby provides for the closing of the fuel valve. This type of structure is well known and used in the burner control field, but the unit typically is operated remotely through a flame safeguard programming device. Usually, the system does not include a manual start and the further function of preventing the manual start from being held in, thereby creating an unsafe condition.

The present system utilizes a manual start switch of the momentary type which is connected through a safety type of switch that requires a manual reset, and which is in turn operated by the movement of the actuator or valve stem to open the switch after the valve has become partially operated. The manual reset switch prevents the manual start switch from being held closed to continuously hold open a valve when the associated control equipment indicates that an unsafe condition exists.

This control relies on the series combination of the manual start switch and a manually resettable switch that is actuated to its open position by the travel of the valve and actuator member. The sequencing of the balance of the switches in the control circuit ensure that the fuel valve can be properly opened, but cannot be held in an open condition by the manual start switch.

DESCRIPTION OF THE PREFERRED EMBODIMENT

Figure 1:
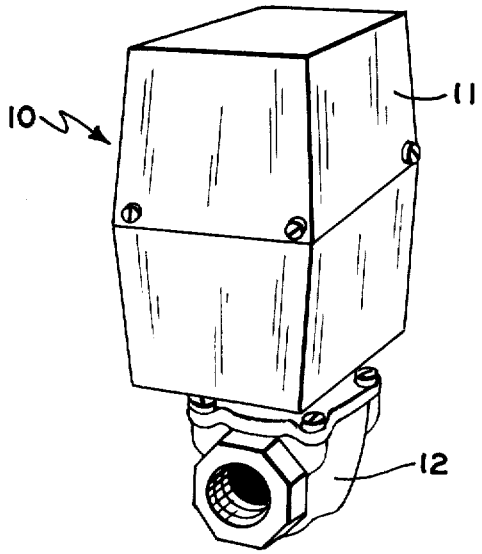
FIG. 1 is a pictorial representation of a hydraulic actuator and an associated valve.

In FIG. 1 a pictorial view of a hydraulically operated fuel valve is generally disclosed at 10. A hydraulic actuator 11 is provided mounted on a valve body 12. The hydraulic actuator 11 contains a pump, fluid reservoirs, an actuator that responds to a fluid pressure, a dump valve, switches, and an actuator mechanism. This type of actuator is generally available. The valve body 12 is designed to be bolted directly to the actuator 11. This combined arrangement provides a hydraulic actuator that is capable of opening and closing a fuel valve, such as the V4055 as sold by Honeywell Inc. and shown on Form 60-2309-6.

The actuator 11 typically functions with a pump by moving a hydraulic fluid against a sealed chamber (which in effect forms a piston) to move an actuator assembly to in turn operate the valve 12. The actuator structure contains springs which are overcome by the operation of the pump force. During the operation of the actuator 11 the enclosed dump valve is energized, and during its energized state cuts off a return passage between the actuator portions. The movement of the actuator structure also operates a number of switches in a sequential order to provide controlled outputs, and these switches include a limit switch to turn the pump off when the actuator has reached its full degree of travel. This type of structure is fail safe in that a power failure deenergizes the pump and the dump valve. The dump valve opens and allows a free flow of fluid between actuator chambers thereby allowing the spring bias in the unit to close the valve 12. This is the normal function during a power failure, or in the mode of return of the valve 12 to its closed position.

Figure 2:
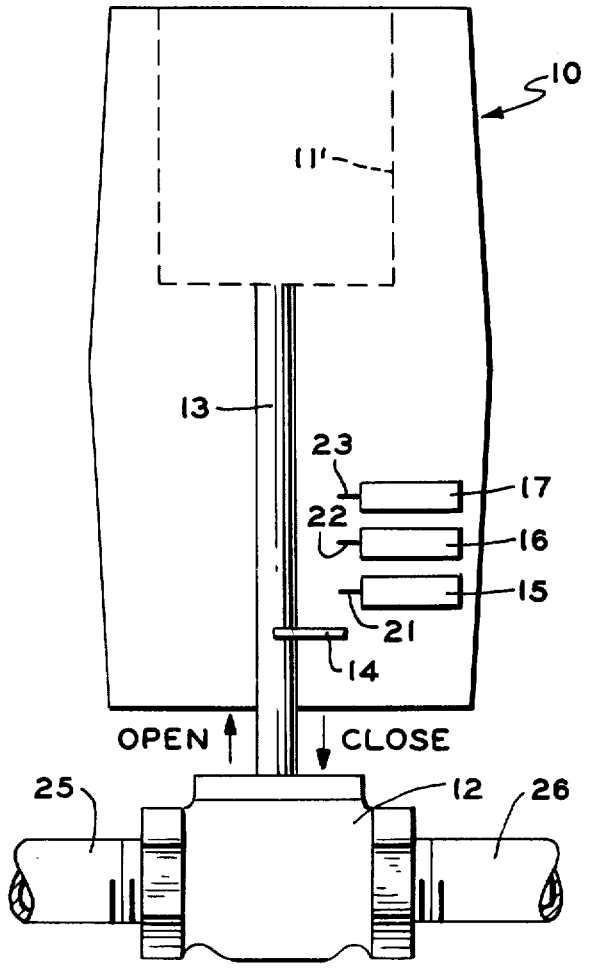
FIG. 2 is a schematic representation of the actuator and valve along with the associated control switches.

In FIG. 2 there is a schematic representation of the structure of the hydraulically operated fuel valve 10. The hydraulic actuator portion is disclosed at 11' and contains the previously mentioned pump, dump valve, and hydraulic actuator mechanism. The output of the hydraulic actuator mechanism is a shaft or actuator member 13 that is mechanically connected to a switch operator mechanism or means 14 so that three switch means 15, 16, and 17 can be operated in sequence. The switch means 15 is a normally open switch, the switch means 16 is a manually resettable normally closed switch which does not maintain contact when the reset button on the switch means is held down, and the switch means 17 is a conventional normally closed limit switch means. The movement of the shaft 13 causes the operator means 14 to progressively strike operating portions 21, 22, and 23 for the switch means 15, 16, and 17 so that the switches are operated in sequence.

The shaft 13 further enters the valve 12 which has an inlet 25 and an outlet 26 for the control of fuel to a conventional fuel burner. The opening and closing directions for the movement of the shaft 13 are disclosed. It will be noted that when the actuator 11' is deenergized and the shaft 13 moves in a downward direction, the valve 12 is closed. This action occurs under a spring force contained in the actuator 11'. When the actuator 11' is energized so that the pump motor is actively pumping and the dump valve is held closed, the actuator 11' moves the shaft 13 in an upward direction thereby opening the valve 12. The opening and closing directions can be reversed depending on the design of the valve 12 and actuator 11'.

To this point, with the exception of the particular switch means 15, 16, and 17 and their operation, the disclosed hydraulic actuator means and valve corresponds to the device disclosed in FIG. 1. The unique operation of the present arrangement will be better understood when the particular types of switch means 15, 16, and 17 are more fully disclosed along with the circuitry involved in their operation. This disclosure is contained in FIG. 3.

Figure 3:
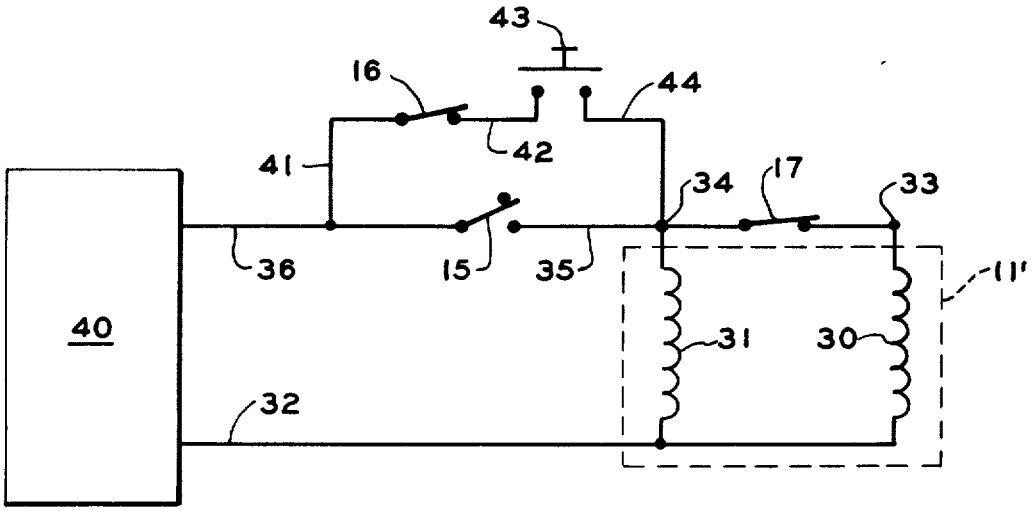
FIG. 3 is a schematic of the control system incorporating the hydraulic actuator, valve, and novel switching.

In FIG. 3 a schematic representation of the present system is disclosed. The actuator 11' is disclosed in a dash block wherein a pump motor coil 30 is disclosed, as well as the dump valve coil 31. The pump motor and dump valve are connected to a common conductor 32. The top end 33 of the pump motor 30 is connected through the normally closed switch 17 that acts as a limit switch for the actuator and valve assembly. The limit switch 17 is connected at 34 to the dump valve 31 thereby placing the dump valve 31 and the pump motor 30 in effective parallel when the limit switch means 17 is closed.

The junction 34 is connected to a conductor 35 which in turn is connected to the normally open switch means 15. The normally open switch means 15 is connected by a conductor 36 to a flame safeguard programming device 40, such as the R4140 flame safeguard programmer as sold by Honeywell Inc. and shown on Form 60-2274, that acts as an electric source means for energizing the dump valve 31 and the pump motor 30 when it is appropriate to open the valve 12. The electric source means or flame safeguard programmer 40 removes power from the conductors 32 and 36 when the valve 12 is to be closed under the spring force contained within the actuator 11'.

The circuit is completed by the addition of a shunt around the switch means 15. The shunt includes a conductor 41 that is connected to the switch means 16 which in turn is connected by a conductor 42 to a manual start switch 43. The manual start switch 43 completes a circuit between the conductor 42 and a further conductor 44 that is connected to the junction 34. The manual start switch 43 is a spring-loaded switch that must be manually depressed to short between the conductors 42 and 44. The switch means 16 is a manual reset type of switch sometimes referred to as a safety switch. The switch 16 requires a manual force to reset it once it has been opened, and the manual force when applied keeps the circuit between the conductors 41 and 42 open circuited until the switch means is physically released. This type of safety switch means has been used in various types of safety equipment and is not unique in and of itself.

OPERATION

The operation of the device will be explained by referring to the circuit of FIG. 3 as it causes the mechanical operation of the structure disclosed in FIG. 2. At a manual start, assuming that the flame safeguard programming means or electric source means 40 is applying a voltage on conductors 36 and 32, the pressing of the switch 43 will allow current to flow through the normally closed switch means 16 to the junction 34. This allows the energization of the dump valve 31 and the simultaneous energization of the pump motor 30. With the dump valve 31 energized, it is closed and cuts off the bypass in the hydraulic system contained in the actuator 11'. The pump motor is energized supplying a hydraulic pressure. The pump motor 30 supplies sufficient hydraulic pressure to slowly overcome the spring loading contained in the actuator 11' and the shaft 13 is slowly moved in an upward or open direction for the valve 12. It is obvious that the opening and closing directions could be reversed and this merely would require the reversal of the switch operating mechanism 14 and the switch means 15, 16, and 17.

As the shaft 13 continues to move, the actuator operating mechanism 14 initially engages the operator 21 of the switch means 15. This then closes the normally open switch means 15 thereby supplying a source of power to the terminal 34 for the dump valve 31 and the pump motor 30. At this point the manual start switch 43 can be opened and the system will continue to operate until the valve 12 is fully opened. If it is assumed that normal operation continues, the shaft 13 continues to move in an upward direction until the operating mechanism 14 engages the member 22 to act on switch means 16 thereby opening the switch means 16 which is normally closed. This opens a series circuit to the manual start switch 43 and prevents the manual start switch 43 from holding the system in operation in the event that the electric source means or flame safeguard programmer 40 calls for some other action, such as the closing of the valve 12.

Assuming that the system continues to operate, the shaft 13 continues to rise and eventually the switch operating mechanism 14 strikes the member 23 of the switch means 17 thereby opening the normally closed limit switch means 17. This deenergizes the pump motor and stops the opening action of the valve. This is the normal, fully open position. It will be noted that power is continously supplied to the dump valve 31 thereby keeping the system in this position.

In the event of a power failure or the requirement that the valve close, power is removed from the conductors 36 and 22. This allows the dump valve 31 to become deenergized and the fluid in the actuator mechanism of the hydraulic actuator 11' is allowed to bypass the pump. The shaft 13 is forced in a downward direction to close the valve 12. At this point the switch means 16 is open, and the system will not automatically respond to a restoration of power.

In order to restore the operation of the system, the switch means 16 must be manually closed to the position shown in FIG. 3. At that time the manual start switch 43 can again be activated. If the manual start switch 43 is blocked into a closed position, the operation of the actuator will open the switch means 16, and it will latch open and require a manual reset before the system can be put into a normal mode of operation. This prevents an operator who is manually starting a fuel burner from merely blocking the system into operation by pressing the manual start switch. Blocking the manual reset switch 16 into a closed position will do the operator no good as the switch is open circuited until it has been reset.

In a typical device as manufactured according to the present invention, the manual switch 43 and the manual reset switch means 16 would be mounted at or immediately adjacent the actuator means 11 thereby requiring that the operation of the device be under the control of an operator at startup. This is the object of the system and prevents automatic recycling or operation of the device merely by the restoration of power from the electric source means or flame safeguard programmer 40.

The present invention is directed to a very specific manually initiated and safety oriented control system for a fuel valve. The system requires a hydraulically operated actuator means to control the fuel valve, and requires a specific type of switch structure and placement for the system to be operative. While a specific structure and contact arrangement have been specifically disclosed in the present application, various alterations to the disclosed concept are possible. In view of the possible modifications to the circuit and switch structure, the applicant wishes to be limited in the scope of his invention solely by the scope of the appended claims.

The embodiments of the invention in which an exclusive property or right is claimed are defined as follows:

1. A manually initiated, hydraulically operated fuel valve, including: hydraulic actuator means including an electrically operated pump to provide a hydraulic actuating force to move an actuator member against a load, and an electrically operated dump valve to bypass said hydraulic actuator means to allow said load to return said actuator member to a starting position upon said dump valve being deenergized; said load including bias means and a fuel valve; electric source means for energizing said actuator means; a first electric circuit connected to said electric source and said actuator means with said first electric circuit including a momentary manual start switch, and manual reset switch means connected in series to provide an initial energizing circuit for said actuator means; said reset switch means requiring manual reset after operation; second electric circuit means including a normally open control switch means which when closed short circuits said manual start switch and said manual reset switch means; third electric circuit means connecting said dump valve and said pump motor in parallel circuit with said third electric circuit means including normally closed limit switch means which is open circuited when said actuator member moves said valve to an open position; and said actuator member including operator means to sequentially operate said control switch means, said manual reset switch means, and said limit switch means to provide a manual start sequence for said actuator means, but wherein said manual reset switch means ensures that said manual start switch cannot be blocked into a start position to control said actuator means.

2. A hydraulically operated fuel valve as described in claim 1 wherein said actuator means and said fuel valve are spring biased so that said valve moves to a closed position upon deenergization of said actuator or a loss of power from said electric source.

3. A hydraulically operated fuel valve as described in claim 2 wherein said electric source means includes a fuel burner safety control and monitoring system.

4. A hydraulically operated fuel valve as described in claim 3 wherein said manual reset switch means is a switch which is latched upon manual reset and which is open circuited while being reset.

5. A hydraulically operated fuel valve as described in claim 4 wherein said limit switch means is a mechanical switch which opens the circuit to said pump when said actuator means has fully opened said fuel valve.

6. A hydraulically operated fuel valve as described in claim 5 wherein said manual start switch and said manual reset switch means are both located at said hydraulic actuator means.

7. A hydraulically operated fuel valve as described in claim 1 wherein said electric source means includes a fuel burner safety control and monitoring system.

8. A hydraulically operated fuel valve as described in claim 7 wherein said manual reset switch means is a switch which is latched upon manual reset and which is open circuited while being reset.

9. A hydraulically operated fuel valve as described in claim 8 wherein said manual start switch and said manual reset switch means are both located at said hydraulic actuator means.

* * * * *